US008943999B2

(12) United States Patent
Giarrizzo, Jr.

(10) Patent No.: US 8,943,999 B2
(45) Date of Patent: Feb. 3, 2015

(54) VEHICLE COLLISION REPAIR ZONE

(75) Inventor: Michael Giarrizzo, Jr., Chagrin Falls, OH (US)

(73) Assignee: DCR IP Company, LLC, Mentor, OH (US)

( * ) Notice: Subject to any disclaimer, the term of this patent is extended or adjusted under 35 U.S.C. 154(b) by 411 days.

(21) Appl. No.: 12/755,025

(22) Filed: Apr. 6, 2010

(65) Prior Publication Data

US 2011/0041757 A1 Feb. 24, 2011

Related U.S. Application Data

(60) Provisional application No. 61/167,035, filed on Apr. 6, 2009.

(51) Int. Cl.

| | |
|---|---|
| ***B05C 13/00*** | (2006.01) |
| ***B05B 15/12*** | (2006.01) |
| *B05C 15/00* | (2006.01) |
| *B05B 13/04* | (2006.01) |

(52) U.S. Cl.

CPC ..... *B05B 15/1207* (2013.01); *B05C 15/00* (2013.01); *B05B 13/0452* (2013.01); *B05B 15/1214* (2013.01); *B05B 15/1222* (2013.01); *B05B 15/1292* (2013.01)

USPC ..... 118/326; 118/300; 118/324

(58) Field of Classification Search

CPC ..... B05B 15/1207; B05B 15/1292; B05B 13/0452; B05B 15/1222; B05B 15/1214; B05C 15/00

USPC ..... 118/300, 324, 326, DIG. 7; 427/424, 427/427.1, 427.2, 427.3; 52/36.1, 36.2; 454/50, 53, 55; 72/705

See application file for complete search history.

(56) References Cited

U.S. PATENT DOCUMENTS

| | | | | |
|---|---|---|---|---|
| 4,932,316 | A * | 6/1990 | Josefsson | 454/50 |
| 5,922,399 | A | 7/1999 | Kobayashi | |
| 2004/0045338 | A1 | 3/2004 | Dobbins et al. | |
| 2005/0257358 | A1 * | 11/2005 | Giarrizzo, Jr. | 29/402.08 |
| 2006/0292308 | A1 | 12/2006 | Clifford et al. | |
| 2008/0229925 | A1 | 9/2008 | Wieland et al. | |

FOREIGN PATENT DOCUMENTS

| | | | |
|---|---|---|---|
| CA | 2177295 | A1 | 3/1997 |
| GB | 2305376 | A | 4/1997 |
| JP | 09-075802 | A | 3/1997 |

OTHER PUBLICATIONS

PCT/US2010/001033—Written Opinion of the International Searching Authority, Dec. 21, 2010.

PCT/US2010/001033—International Search Report, Dec. 21, 2010.

* cited by examiner

*Primary Examiner* — Laura Edwards

(74) *Attorney, Agent, or Firm* — Curatolo Sidoti Co., LPA; Salvatore A. Sidoti; Floyd Trillis, III

(57) ABSTRACT

Provided is a spray booth that includes a housing and a mechanism for advancing the vehicle through the housing. The spray booth may include a rail system that extends along the long axis of the housing and is off-set from the center of the short axis of the housing for advancing vehicles. The spray booth housing includes walls that define an area for locating a vehicle to be painted. The area defined by the walls includes regions for priming a vehicle to be painted, preparing a vehicle to be painted, and distinct painting areas for separately painting the vehicle that is engaged with the rail system and for painting parts that are not attached to the vehicle. The spray booth may also include one or more air handling systems for handling air that is flowed through the spray booth during the preparation and paint operations.

16 Claims, 2 Drawing Sheets

VEHICLE COLLISION REPAIR ZONE

CROSS REFERENCE TO RELATED APPLICATIONS

This application claims the benefit of the filing date under 35 U.S.C. 119(e) from U.S. Provisional Application For Patent Ser. No. 61/167,035, filed Apr. 6, 2009, which is incorporated herein by reference in its entirety.

TECHNICAL FIELD

The disclosed subject matter relates to a vehicle collision repair zone that includes a spray booth for painting vehicles. The disclosed subject matter more particularly relates to a vehicle collision repair zone that includes an off-set rail system and an air handling system where air is flowed into the booth housing, is drawn across the vehicle being sprayed, and is extracted to the environment outside the spray booth.

BACKGROUND

Spray booths are used in vehicle collision repair facilities to provide a distinct area to paint vehicles undergoing collision repair. The spray booth provides a generally enclosed area to protect the vehicle being painted from debris from the surrounding environment and to contain paint overspray and other particulate debris from the preparation or painting processes from diffusing throughout the facility.

Paint spray booths generally include distinct areas within the confines of the outer walls to carry out different steps of the preparing and painting processes. For example, paint spray booths typically include distinct areas that are devoted to priming, filling and painting the vehicle being repaired. The vehicle is advanced sequentially through these distinct areas until the painting process is complete.

In many instances, there are damaged parts of the vehicle that must be removed and repaired, or otherwise entirely replaced, during the vehicle collision repair process. In either scenario, both the parts that remain attached to the vehicle and parts that have been removed must be painted. In current paint spray booths used in the vehicle collision repair industry, there is only a single prescribed painting zone located within the spray booth. Therefore, it is common to paint parts that have been removed from the vehicle in an area remote from the single prescribed painting zone of paint spray booth or to remove the painted vehicle from the spray booth after painting and position the removed parts from the painted vehicle into the single prescribed painting zone that was previously occupied by the painted vehicle for painting. Both of these traditional processes essentially double the time to complete the overall painting and drying stages of the vehicle collision repair process and is disruptive to the flow of product throughout the collision repair process.

SUMMARY

Provided is a vehicle collision repair zone comprising a plurality of walls defining said zone having a long axis and a short axis, at least two painting regions located within said zone, and means for advancing an object to be painted through said zone along of the long axis of said zone, wherein said means for advancing is off-set from the center of said short axis of said zone.

According to certain illustrative embodiments, the vehicle collision repair zone comprises a plurality of walls defining said zone, wherein said zone comprises a priming region, a painting preparation region and at least two distinct painting regions; and means for advancing a vehicle to be painted through said zone.

According to certain illustrative embodiments, the vehicle collision repair zone comprises a plurality of walls defining said zone, wherein said zone comprises a priming region, a painting preparation region and at least two distinct painting regions means for advancing a vehicle through said zone, and one or more air handling systems.

According to certain illustrative embodiments, the vehicle collision repair zone comprises a plurality of walls defining said zone, wherein said zone comprises a priming region, a painting preparation region and at least two distinct painting regions means for advancing a vehicle through said zone, a first air handling system, and a second air handling system engaged with a tool.

DETAILED DESCRIPTION

Figure 1:
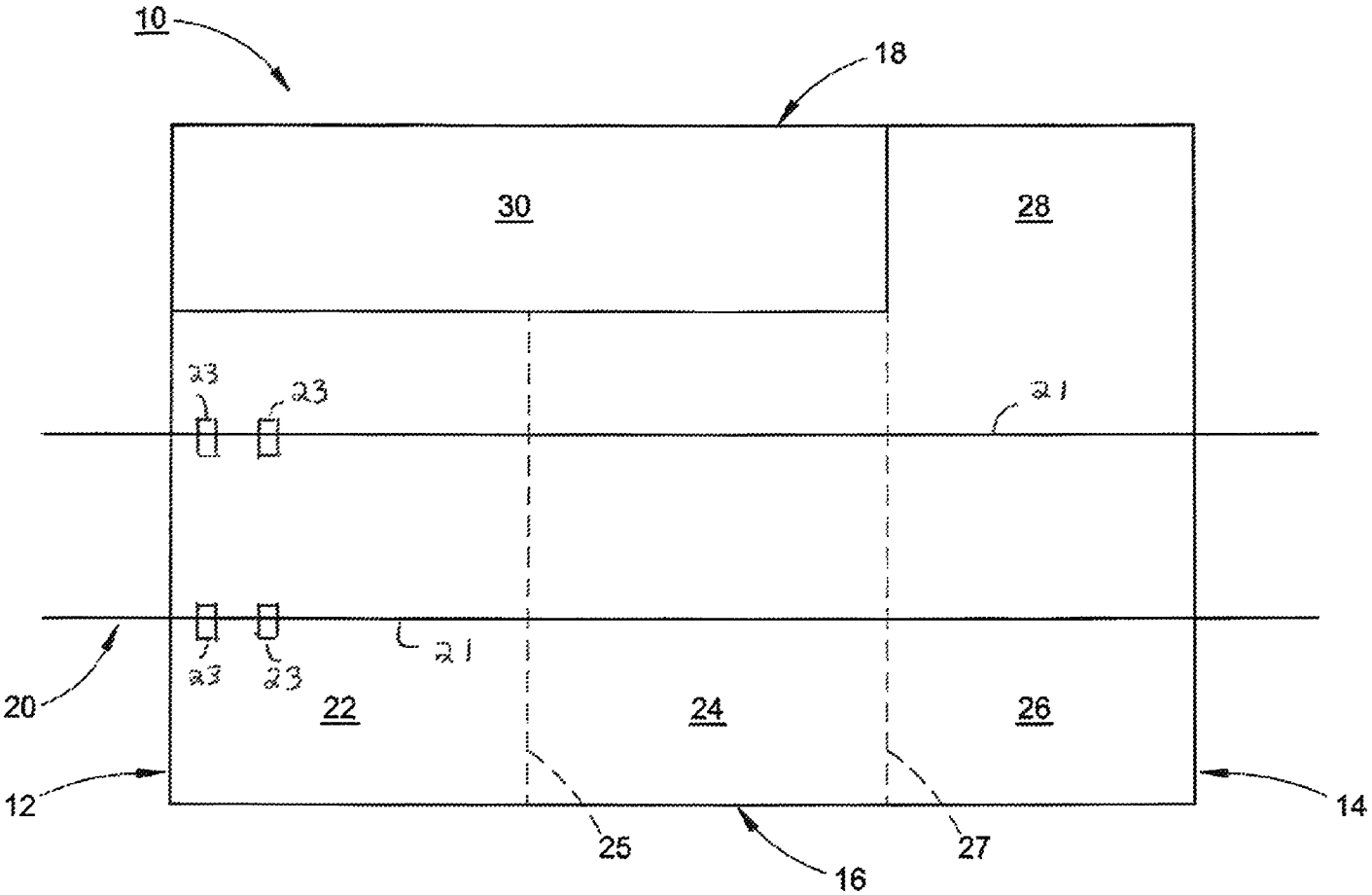
FIG. 1 is a plan view of an illustrative embodiment of the paint spray booth.

Provided is a vehicle collision repair zone including spray booth region for spraying vehicles during a collision damage repair process. The paint spray booth region provides a generally contained area to apply a spray to a vehicle and to contain debris that is generated during the preparation and painting processes.

The vehicle collision repair zone comprises a plurality of walls defining a zone and means for advancing an object to be painted through the zone. The zone defined by the plurality of walls includes a plurality of distinct regions. According to certain embodiments, each distinct region within the area defined by the walls of the paint zone is dedicated to carrying out one or more operations of the vehicle painting process. By way of illustration, according to certain embodiments, the zone defined by the plurality of walls includes distinct priming, preparing, and painting regions. The zone includes two or more distinct painting regions for carrying out separate painting operations.

The provision of the two distinct paint regions permits a single painting and drying process for the vehicle itself and for parts that have been removed from the vehicle during the collision repair process. Parts that have been removed from the vehicle can be painted either simultaneously or substantially simultaneously as the vehicle is itself being painted. Accordingly, parts removed from the vehicle do not need be painted in an area remote from the paint spray booth or wait until the painted vehicle is moved from the previously occupied vehicle paint region of the booth.

The vehicle collision repair zone includes a long axis that extends from the front entry to the zone to the rear exit of the zone. The vehicle collision repair zone also includes a short axis that extends between the side walls of the vehicle collision repair zone. The vehicle collision repair zone includes a rail system for advancing vehicles undergoing vehicle collision repair through the various regions within the vehicle collision repair zone. The rail system extends along the long axis of the vehicle collision repair zone substantially from the front entry of the zone to the rear exit of the zone. It should be noted, however, that the rail system does not need to extend along the entire length of the long axis of the vehicle collision repair zone from the front entry to the rear exit of the zone, and may be only extend along the long axis within certain regions of the zone. The rail is located at a position within the vehicle collision repair zone that is off-set from the center or middle of the short axis of the vehicle collision repair zone. In other words, the rail system is not located at the center or middle point between the side walls of the vehicle collision repair zone.

According to other illustrative embodiments, the vehicle collision repair zone also includes a plurality of walls defining a zone, means for advancing a vehicle through said zone, and one or more air handling systems for handling air used in the painting process. According to certain embodiments, each distinct region within the zone defined by the walls of the paint spray booth is dedicated to carrying out one or more operations of the vehicle painting process. By way of illustration, according to certain embodiments, the zone defined by the plurality of walls includes distinct priming, preparing, and painting regions. The zone includes two or more distinct painting regions for carrying out separate painting operations.

According to further illustrative embodiments, the vehicle collision repair zone comprises a plurality of walls defining a zone, means for advancing a vehicle through said zone, a first air handling system, and a second air handling system engaged with an air extraction tool. Each distinct region within the zone defined by the walls of the zone is dedicated to carrying out one or more operations of the vehicle painting process. By way of illustration, according to certain embodiments, the zone defined by the plurality of walls includes distinct priming, preparing, and painting regions. The area includes two or more distinct painting regions for carrying out separate painting operations.

The vehicle collision repair zone effectively contains the particulate generated by a spraying process, and the air handling systems facilitates its capture, removal, and/or elimination. The debris generated by such operations may include, but is not limited to, paint overspray, paint drippings, paint chips, paint dust, primer overspray, primer drippings, primer chips, primer dust, and filler dust. The air handling systems of the spray booth are also capable of treating air entering the spray booth and treating air exiting the spray booth, thereby providing air suitable for use in the spraying processes and removing debris from the spray booth attributable to primer, filler compositions, and/or paint.

According to certain embodiments, the walls of the vehicle collision repair zone may comprise distinct rigid wall panels that are joined in some manner to define the area for locating the vehicle to be spray painted. The bottom of the walls may include seals to affect a positive seal between the walls of the various regions within the zone and the floor of the zone. Alternatively, the side walls of the zone may comprise one or more curtains that are hung from the ceiling of the housing.

The first air handling system is in fluid communication with the ambient environment outside of the housing and the interior of the zone. The first air handling system is capable of circulating air from the ambient environment into the interior volume of the zone, drawing that air across and past the vehicle being sprayed and circulating the air from the interior volume back to the ambient environment. The circulating air is capable of conveying particulate material generated during the painting process, or any process is preparation for the painting process, from the interior volume of the vehicle collision repair zone.

The first air handling system comprises a device to create air flow and a device to remove particulate material from the intake air. According to certain embodiments, the first air handling system includes comprises air intake duct for receiving air from the outside ambient environment. The intake air is drawn into the air handling system by the device to create air flow, such a fan or blower, which is in fluid communication with the air intake duct. The fan is at least partially located within a plenum that is in fluid communication with the air intake duct. Once the intake air enters the first air handling system through the air intake duct and passes through the plenum, it further passes through a filter medium that is in communication with the plenum to filter out particulate from the intake air.

The first air handling system also includes an air extraction duct that is located near the opposite side of the spray booth housing from the air intake. An air extraction means, such as fan or blower, is at least partially located within the air extraction duct to draw exhaust air into the extraction duct. A filter medium is located in fluid communication with the extraction duct to filter out particulate generated in the spray booth housing from the spraying process.

The vehicle collision repair zone also includes a tool that is used during a spraying process or a process that precedes a spraying process. The tool is in fluid communication with a second air handling system that is capable of drawing air from end tool and exhausting the air drawn from the tool to the outside ambient environment. The second air handling system comprises a movable air intake conduit that is engaged with and is in fluid communication with the end tool, a static air conduit, a device to create air flow, and an exhaust duct. According to certain embodiments, the movable air intake of the second air handling system includes flexible conduit, such as a flexible hose, that is in communication with the end tool and a static duct that is in communication with the flexible hose.

Illustrative embodiments of the vehicle collision repair zone will now be described in greater detail with reference to the FIGURES. It should be noted that the vehicle collision repair zone and methods of using the spray booth are not intended to be limited to the illustrative embodiments shown in the FIGURES.

Referring to FIG. 1, an illustrative embodiment of the vehicle collision repair zone 10 is shown. Vehicle collision repair zone 10 includes front wall 12, rear wall 14 and side walls 16, 18. Vehicle collision repair zone 10 also includes a means 20 for advancing a vehicle undergoing collision repair through the zone 10. A rail system 20 may be used to advance a vehicle undergoing collision repair through the zone. According to certain embodiments, the rail system 20 may be used to advance the vehicles laterally through the priming region, a paint preparation/masking region, and a paint spray booth along the rail system 20 within zone 10. According to these embodiments, the term "laterally" means that the leading edge of the vehicle being advanced throughout the zone along the rail system is a lateral side of the vehicle, rather than the front or rear end of the vehicle.

The rail system 20 of zone 10 generally includes elongated, substantially parallel rail or track members 21. The rail system 20 also includes means (not shown) that are movably engaged with the rail or track members 21. Without limitation, means may be provided in the form of movable skates, which are also adapted to engage the wheels of a vehicle undergoing collision damage repair. In this regard, the skates are adjustable to accommodate the wheel base size of the vehicle being repaired. In operation, the vehicle undergoing collision repair is engaged with the rail system 20 via the movable rail skates. Through the use of rail system 20, the collision damage repair technician has the ability to easily advance a vehicle, along rail system 20 successively throughout the different regions of the zone 10.

In an alternative embodiment, the rail system of vehicle collision repair system 20 may be driven by a motor. According to this embodiment, the motor driven rail system also includes a power source for driving the motor and suitable control to permit the repair technician to control the flow of the vehicle along the rail.

According to another embodiment, the means for advancing the vehicle through the vehicle collision repair zone 10 may not include a rail system, According to this embodiment, the vehicle is engaged with movable skates and is advanced through regions of the zone 10. Suitable moveable skates that may be used in connection with the vehicle collision repair system and process are rollable skates that are commercially available from Eastwood Co. under the trade designation GO JAKS.

Vehicle collision repair zone 10 is defined define by a plurality of walls 12, 14, 16, 18. Vehicle collision repair zone 10 includes distinct regions within the zone that are defined by the walls 12, 14, 16, 18 and inner walls 25, 27 that are dedicated to carrying out one or more different operations of the vehicle painting process. By way of illustration, according to certain embodiments, the zone 10 defined by the plurality of walls 12, 14, 16, 18 includes a distinct region 22 for carrying priming operation, a region 24 for carrying out a paint preparation operation, and region 26 for carrying out a painting operation.

The vehicle collision repair zone 10 includes a long axis L that extends from the front entry of the zone 10 to the rear wall 14 of the zone 10. The vehicle collision repair zone 10 also includes a short axis S that extends between the side walls 16, 18 of the vehicle collision repair zone 10. The vehicle collision repair zone 10 includes a rail system 20 for advancing vehicles undergoing vehicle collision repair through the various regions 22, 24, 26 within the vehicle collision repair zone 10. The rail system 20 extends along the long axis L of the vehicle collision repair zone substantially from the front entry 12 of the zone to the rear wall of the zone 14. The rail 20 is located at a position within the vehicle collision repair zone that is off-set from the center or middle of the short axis S that extend between the side walls 16, 18 of the vehicle collision repair zone 10. In other words, the rail system is not located at the center or middle point between the side walls 16, 18 of the vehicle collision repair zone 10.

Because the rail system 20 is off-set from the center of the short axis extending between side walls 16, 18 of the zone 10, an additional painting region 28 is provided within the confines of the zone 10. Painting regions 26 and 28 enable the zone 10 to accommodate more than one painting operations on distinct parts. For example, the vehicle being repaired remains engaged with the rail systems 20 and parts attached to the vehicle are painted in painting region 26. Another painting operation may be simultaneously carried out in painting region 28 on parts that have been removed from the vehicle being painted in area 26 or replacement parts intended to be installed on the vehicle being painted in area 26.

According to the illustrative embodiment shown in FIG. 1, painting areas 26, 28 are positioned in a side-by-side fashion near the rear of zone 10. However, it should be noted that painting areas 26, 28 are not limited to positioning shown in FIG. 1 and may comprises a wide variety of layouts. Furthermore, zone 10 may include more than two painting areas.

The regions 26, 28 of zone 10 may include a ceiling and at least one side wall for providing an area to locate the object to be sprayed and to contain overspray and other debris from spraying processes. Both can be of any size and shape suitable to contain the desired portion of the object to be sprayed. In certain embodiments the regions 26, 28 will be capable of containing the entire objects to be sprayed.

The walls 12, 14, 16, 18 defining the zone 10, or the inner walls 25, 27 defining the regions 22, 24, 26, may be rigid or flexible. The zone 10 may comprise one or more openings to permit fluid or other communication between the ambient environment and the interior volume of the zone 10. Openings in the zone 10 may comprise doors, gates, louvers, air flow devices, or other devices to control fluid or other communication between the ambient environment and the interior volume. Openings in the zone 10 may be used to insert a work object into the interior volume, to remove a work object from the interior volume, to permit air flow from the ambient environment to the interior volume, to permit air flow from the interior volume to the ambient environment, to permit other communication, or some combination thereof.

Area 30 within zone 10 represents a material supply and preparation area. For example, paint a mixing station or work area may reside within area 30. Additionally, portions of the air handling systems for the vehicle collision repair zone 10 reside within area 30.

Figure 2:
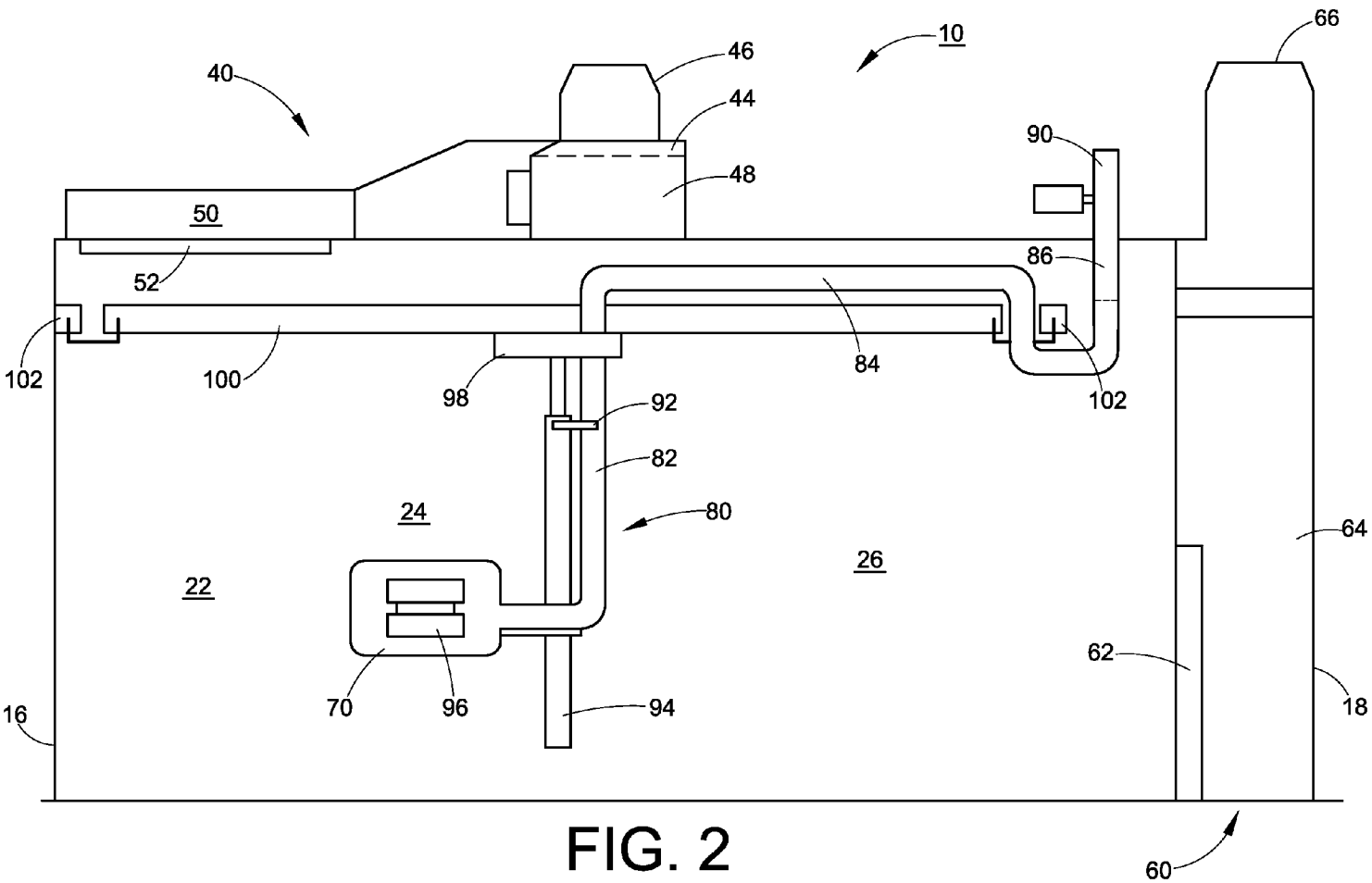
FIG. 2 is an elevational view of an illustrative embodiment of the paint spray booth.

Referring now to FIG. 2, the zone 10 may include a first air handling system 40 that is in fluid communication with the ambient environment and the interior volume of the vehicle collision repair zone 42. The first air handling system 40 includes means for drawing air into the zone 42 and means for exhausting air from the zone 42. The first air handling system 40 is capable of drawing air from the ambient environment into the interior volume of the zone 42 and exhausting air from the interior volume to the ambient environment. The first air handling system 40 comprises a fan, blower, compressor, or other device to create circulating air flow. In certain embodiments, the first air handling system 40 comprises a fan 44 that is in fluid connection with an air intake duct or opening 46 in the zone 42 which permits fluid communication between the ambient environment and the interior volume of the zone 42. In such embodiments, the fan 44 can promote flow of fluids, such as air, through the opening 46. Without limitation, the fan 44 may be directly connected to the opening 1 or it may be connected to the opening 46 by means of a duct, tube, hose, pipe, or other fluid conduit.

In certain embodiments, a fluid connection between the fan 44 and the opening 46 with which it is connected comprises a flow modifier such as, without limitation, a plenum chamber. Other components which can affect the temperature, speed, pressure, humidity, or other property of the air flow, such as a venturi, a heater, a cooler, a humidifier, a de-humidifier, may be included in the first air handling systems 34. The first air handling system 34 may include a heater 48 to heat the air and a plenum 50 to modify flow of air to the zone 42.

The first air handling system 40 may also comprise a filter 52 for filtering debris from the intake air. The filter 52 may comprise a dry filter, wet filter, precipitator, catalyst, or other device to remove debris from the intake air. In certain embodiments, the first air handling system 40 comprises a filter 52 that is in fluid connection to the air intake duct or opening 46 in the zone 42 which permits fluid communication between the ambient environment and the interior volume of the zone 42 but resists the passage of debris. The manner in which the filter 52 will remove debris from the circulating air depends upon the type of filter 52. Without limitation, in certain embodiments, the filter 52 is a dry filter which allows passage of circulating air but which captures debris consisting of particles larger than the dry filter pass size. Handling of air through the zone 42 creates an air flow which picks up debris and conveys the debris along with the air flow. By transporting the circulating air flow through a filter 52, the transported debris is handled by the filter 52. According to the illustrative embodiment shown, filter 52 is in fluid communication with the opening 46 via plenum 50.

The first air handling system 40 includes means 60 for exhausting circulating air from the interior of the zone 42. The air circulating within the interior volume of the zone 42 passes through filter 62 in order to filter out particulate debris from the painting process and passes into exhaust or extract duct 64. The air is drawn through filter 62 and into duct 64 by means of a fan that is positioned with at least a portion of duct 64. The air that is drawn in duct 64 exits the zone 42 through exhaust opening 66.

The zone 10 further includes an end tool 70 for use in a painting operation or a preparation operation prior to painting. In certain embodiments, the end tool 70 comprises a shroud or hood or similar barrier to isolate or mask a desired region. In certain embodiments in which the end tool 70 comprises a hood, the hood will comprise an enclosure with an open face. In embodiments in which the end tool 70 comprises a hood with an open face, the open face of the hood may be placed into contact with a surface on the work object such that the surface of the work object acts to close the hood and define a closed work space within the hood. In certain embodiments in which the end tool 70 comprises a hood with an open face, the hood will be connected to a second air handling system 80.

The second air handling system 80 is capable of drawing air from the end tool 70 and exhausting the air from the zone 42. The second air handling system 80 comprises an air intake 82 engaged with the end tool 70, static ducts 84, 86, means to create the flow of air 88, and an air output 90 duct. The means 88 to create air flow may be a fan, blower, or any type of device usable to create air flow. The air intake 82 is in fluid communication with the tool 70, fan 88 and exhaust duct 90. The air intake 82 may be directly connected to the fan 88 or the air intake 82 may be connected to the fan 88 by way of a duct, tube, hose, pipe, or other fluid conduit 84, 86. The air output 90 is in fluid communication with the fan 88. The air output 90 may be directly connected to the fan 88 or the air output 90 may be connected to the fan 88 by way of a duct, tube, hose, pipe, or other fluid conduit. In certain embodiments the secondary air handling system 80 comprises a dry filter, wet filter, precipitator, catalyst or other device to remove debris from the air therein.

In certain embodiments, the air output 90 is fixed with respect to the zone 42. In such embodiments, the air intake 82 will be movable with respect to the fixed air output 90. In embodiments in which the air intake 82 will be movable with respect to the fixed air output 90, fluid conduits having end portions movable with respect to one another while still maintaining integrity may be used to provide fluid communication between the air intake 82 and the air output 90. Fluid conduits having end portions movable with respect to one another while still maintaining integrity include, without limitation, hoses. In certain embodiments, the air output 90 is in fluid communication with the ambient environment.

By connecting the second air handling system 80 to the hood of tool 70 in such a manner as to permit the second air handling system 80 to withdraw draw air from the tool 70, the hood of the tool 70 may be made into a region of lower pressure. By connecting the second air handling system 80 to the hood of the tool 70 in such a manner as to permit the second air handling system 80 to withdraw draw air from the hood of the tool 70, air flow is established within the hood.

In embodiments in which the hood comprises an open face and in which an open face of the hood is placed across a surface on a work object such that the surface of the work object acts to close the hood and define a closed work space within the hood, making the hood into a region of lower pressure promotes a seal between the hood of the tool 70 and the vehicle. This seal aids in isolation of the hooded surface and confinement of debris resulting from work performed within the hood. In certain embodiments a hood of the tool 70 will comprise isolation gloves or other manipulators that allow a user to work upon a hooded region of a work object through the hood 70 while still maintaining a seal.

In certain embodiments, the tool 70 may be engaged to the vertically positioned mounting or retaining element 92 which allows rotation of the end tool 70 about one or more of the three spatial dimensions. In certain embodiments, the support mechanism 94 and the element 92 allow placement of the end tool 70 at a desired position and orientation.

In certain embodiments, the end tool 70 comprises a drying unit 96. A drying unit 96 may comprise a fan, or blower, or compressor, or other device to create air flow. A drying unit 96 may comprise a heater or a de-humidifier, or both. In certain embodiments the end tool 70 will comprise a drying unit 96 within the hood.

Debris generated within the hood may be picked up by air flow within the tool 70 created by the secondary air handling system 80. This air flow can conveys the debris along with the air flow through the secondary air handling system 80. The debris travels through flexible intake 82, through static conduits or ducts 84, 86 and is exhausted to the environment through duct 90. In certain embodiments, debris transported by the secondary air handling system 80 may be processed by filters (a dry filter, wet filter, precipitator, or catalyst) within the secondary air handling system 80 or the debris can be injected into the primary air handling system 40 for removal.

Tool 70 is movably mounted within zone 42 to enable efficiently prepping and painting of a vehicle. The tool 70 is engaged with sledge 98 via a mounting 94. Tool 70 is therefore carried or otherwise supported by sledge 98. Retaining member 92, such as a retaining bracket, is used to affix flexible air intake hose 82 to mounting element 94. The sledge 98 is engaged with a movable carriage system 100. The carriage 100 is movably engaged with a set of spaced apart elongated rails 102. The rails 102 are spaced apart from one another and between them define a first guideway, a surface in space, along which a component movably engaged to the rails 102 may travel. In certain embodiments, there are two rails 102 which are substantially straight elongated members mounted in parallel to one another which define a planar surface between them and along which movably engaged components may travel. In other embodiments, there may be more than two rails, the rails may be non-linear, or non-parallel, or both, such that the first guideway is a complex surface. The carriage 100 is movably engaged to at least two rails 102 and is free to move along the first guideway defined by the rails. In certain embodiments, the carriage 100 is engaged with the rails 102 by means of wheels or rollers or bearings or the like. In certain embodiments the carriage is engaged to the rails 102 by slider bearings or linear bearings or the like. The carriage 100 defines a second guideway between the rails 102 along which a component movably engaged to the carriage 100 may travel. Thus, the elongated rail set 102 permits the carriage 100 to move forward and backward within the zone 42. The extraction conduit 86 is affixed to the carriage 100 via duct 84 so when the carriage system 100 moves the entire second air handling system 80 stays together.

Movably engaged to the carriage 100 is a sledge 98. The sledge 98 can move along the second guideway defined by the carriage 100. Because the carriage 100 can, in turn, move along the first guideway defined by the rails 102, by moving the carriage 100 along the rails 102 and the sledge 98 along the carriage 100, it is possible to place the sledge 98 at a desired position along the surface in space defined by the rails 102. The sledge 98 permits the tool 70 to move from side to side within the housing. The sledge also conveys a vertical retaining element 94. The vertical retaining element 94 may be any element that can engage tool 70 in the vertical direction. Tool 70 is movable up and down along the entire length of the mounting element 94 and is capable of rotating 360 degrees about mounting element 94. The vertical mounting element 94 provides a third degree of freedom. Collectively, the rails 102, carriage 100, sledge 98, and vertical retaining element 100 allow the desired placement of tool 70.

The degrees of freedom provided by the rails 102, carriage 100, sledge 98, and mounting element 94 may include all three position dimensions, all three rotational dimensions, or any subset of these dimensions. In certain embodiments, all of these degrees of freedom are provided and the tool 70 can be located at any position and at any orientation within the zone 42.

While the vehicle collision repair zone has been described in connection with various embodiments, as shown in the various figures, it is to be understood that other similar embodiments may be used or modifications and additions may be made to the described embodiments for performing the same function without deviating therefrom. Furthermore, the various illustrative embodiments may be combined to produce the desired results. Therefore, the spray booth should not be limited to any single embodiment, but rather construed in breadth and scope in accordance with the recitation of the appended claims.

The invention claimed is:

1. A paint spray booth comprising:

a plurality of walls defining said booth having a long axis and a short axis;

at least two painting regions located within said booth;

means for advancing a vehicle to be painted along the long axis of said booth, wherein said means for advancing is off-set from the center of said short axis of said booth;

spaced-apart elongated rails positioned near the front and rear of said booth within said booth;

a carriage engaged with said elongated rails that permit said carriage to move from side to side within said booth;

a sledge engaged with said carriage that permits said sledge to move therewith from side to side within said booth and move from a front to a rear of said booth; and a first air handling system comprising an air extraction tool and conduit in fluid communication with an exhaust duct, wherein said tool is carried by said sledge.

2. The paint spray booth of claim 1, wherein said plurality of walls comprise a front wall, spaced-apart side walls and a rear wall, wherein the distance between the front wall and rear wall defines a long axis of said booth and the distance between the spaced-apart side walls define a short axis of said booth.

3. The paint spray booth of claim 1, wherein a priming region, a painting preparation region and at least two distinct painting regions are located within said booth.

4. The paint spray booth of claim 1, wherein said means for advancing said vehicle comprises a rail system extending along the long axis of said booth from the front of said booth to the rear of said booth.

5. The paint spray booth of claim 4, wherein said rail system comprises spaced-part, substantially parallel rails.

6. The vehicle collision repair zone of claim 5, wherein said means for advancing further comprises rollable skates engaged with said vehicle.

7. The paint spray booth of claim 1, wherein said booth comprises a second air handling system comprises an air intake duct and an air exhaust duct.

8. The paint spray booth of claim 7, wherein said second air handling system further comprises a fan in fluid communication with said air intake duct and a fan at least partially located with said air exhaust duct.

9. The paint spray booth of claim 8, wherein said second air handling system further comprises a plenum in fluid communication with said fan and a filter in fluid communication with said plenum.

10. The paint spray booth of claim 9, wherein said second air handling system further comprises a filter in fluid communication with said exhaust duct to filter air that has passed though said booth.

11. The paint spray booth of claim 1, wherein said exhaust duct comprises a movable conduit and a static duct in communication with said air extraction tool and said exhaust outlet.

12. The paint spray booth of claim 11, wherein said air extraction tool and said movable conduit are carried by said sledge.

13. The paint spray booth of claim 12, wherein said air extraction tool and movable conduit are engaged with said sledge by a mounting that is engaged with said sledge.

14. The paint spray booth of claim 1, comprising a mounting engaged with said sledge and wherein said tool is movable up and down along said mounting and rotatable 360 degrees about said mounting.

15. The paint spray booth of claim 14, wherein said booth comprises a second air handling system having an air intake duct and an air exhaust duct, wherein a fan is in fluid communication with said air intake duct and a fan is at least partially located with said air exhaust duct.

16. The paint spray booth of claim 15, wherein said second air handling system further comprises a filter in fluid communication with said exhaust duct to filter air that has passed though said booth.

* * * * *